US005543904A

United States Patent [19]

Kato et al.

[11] Patent Number: 5,543,904

[45] Date of Patent: Aug. 6, 1996

[54] FIXATING DEVICE

[75] Inventors: Motoi Kato; Akihiko Takeuchi, both of Yokohama; Toshihiko Ochiai, Tokyo; Toshiaki Miyashiro, Ichikawa; Nobuaki Kabeya, Toride; Takehiko Suzuki; Takao Kume, both of Yokohama, all of Japan

[73] Assignee: Canon Kabushiki Kaisha, Tokyo, Japan

[21] Appl. No.: 429,240

[22] Filed: Apr. 25, 1995

[30] Foreign Application Priority Data

Apr. 28, 1994 [JP] Japan ..... 6-111784

[51] Int. Cl.[6] ..... G03G 15/20

[52] U.S. Cl. ..... 355/285; 355/208

[58] Field of Search ..... 355/285, 290, 355/208; 219/216, 470

[56] References Cited

U.S. PATENT DOCUMENTS 4,905,051 2/1990 Satoh et al. ..... 355/290

5,329,343 7/1994 Saito ..... 355/290

5,331,385 7/1994 Ohtsuka et al. ..... 355/290

*Primary Examiner*—Arthur T. Grimley

*Assistant Examiner*—Q. Grainger

*Attorney, Agent, or Firm*—Fitzpatrick, Cella, Harper & Scinto

[57] ABSTRACT

A fixating device has a first rotatable member in contact with an unfixated image borne on a recording medium, a second rotatable member forming a nip together with the second rotatable member, a first heater for heating the first rotatable member, a second heater for heating the second rotatable member, and power supply controlling means for controlling the supply of electric power to the first heater and the second heater. The power supply controlling means is adapted to control the supply of electric power so that when the electric power supplied to the first heater is Wa and the electric power supplied to the second heater is Wb and the ratio when the recording medium is nipped between and conveyed by the first rotatable member and the second rotatable member is Dp=Wa/Wb and the ratio during standby is Ds=Wa/Wb, there may be established Dp>Ds.

6 Claims, 8 Drawing Sheets

FIXATING DEVICE

BACKGROUND OF THE INVENTION

1. Field of the Invention

This invention relates to a fixating device for use in an image forming apparatus such as a copying apparatus or a printer, and particularly to a fixating device capable of heating a recording medium from its both sides.

2. Related Background Art

In recent years, the production of color copying apparatuses of the electrophotographic type has been done actively, and since this type is excellent in image quality and running costs as compared with the other types, its market has widened. Further, the application of this type to color printers is going on and the age of color DTP is about to spread. Accordingly, in a fixating device for color used in such an image forming apparatus, it is regarded as being necessary to improve the mixability of colors and OHP transmissivity in terms of image quality.

So, in order to heat both of toners and paper equally and sufficiently melt and mix thick toner images of multiple colors superposed one upon another, there has been proposed a construction in which heaters as heat sources are provided in both of a fixating roller and a pressing roller. Also, with regard to temperature control, it is possible to bring a thermistor into contact with the surface of each roller and detect the surface temperature of each roller to thereby effect temperature control, but such control becomes complicated in itself and leads to an increased cost and therefore, it is preferable to bring the thermistor into contact with only the surface of one of the two rollers and detect the surface temperature thereof to thereby effect temperature control.

This system, however, has suffered from the following disadvantages. First, from the viewpoints of the stability of temperature control and fixative property, it is desirable that the temperature difference between the upper and lower rollers be within the order of 10° C., and to make the rising characteristics of the upper and lower rollers equal to each other and suppress overshoot, it is necessary to make the ratios of heater rated output to roller heat capacity equal for the respective ones of the upper and lower rollers.

However, even in such a construction wherein the rising characteristics are uniformized, there has been the problem that when the upper and lower rollers are left stopped upon standby, a heat difference is created between the upper and lower rollers by the amount of escape of heat, i.e., the so-called heat leak, of the upper and lower rollers. One of the causes of the creation of such heat difference has been that as shown in FIG. 12 of the accompanying drawings, a hot air stream flows from the lower roller 2 side to the upper roller 1 side, whereby a temperature gradient which becomes upwardly higher is formed in the fixating unit itself.

Accordingly, in a system wherein the thermistor is brought into contact with the lower roller to effect temperature control, the upper roller side is smaller in heat leak and more liable to rise in temperature than the lower roller side, and this has led to the disadvantage that the life and safety of the roller are low. Also, in a system wherein the thermistor is brought into contact with the upper roller, the lower roller side becomes liable to fall in temperature and unless pre-rotation is effected long before printing, the temperatures of the upper and lower rollers will not be stable.

Further, when the heat leak difference between the upper and lower rollers is measured and the rated electric power of the upper roller is set to a value lower than the rated electric power of the lower roller to thereby make the temperature difference between the upper and lower rollers smaller, the temperature difference becomes null during standby and attains an effect, but conversely a temperature difference is given birth during continuous print output.

SUMMARY OF THE INVENTION

The present invention has been made in view of the above-noted problems and an object thereof is to provide a fixating device in which even when one of two rollers is brought into contact with a thermistor, the heat difference between the two rollers during standby can be eliminated without the pre-rotation before printing being effected long and without any temperature difference being created between the two rollers during printing.

Another object of the present invention is to provide a fixating device in which the temperature difference between two rollers can be eliminated by appropriate temperature control even when the rise rate or the fall rate of temperature is changed by a change in environment.

Still another object of the present invention is to provide a fixating device in which the temperature difference between two rollers can be eliminated by particularly the temperature rise of the upper roller being suppressed.

Yet still another object of the present invention is to provide a fixating device in which the temperature difference between two rollers can be eliminated by particularly the temperature fall of the lower roller being suppressed.

A further object of the present invention is to provide a fixating device in which the consumption of electric power can be reduced.

Still a further object of the present invention is to provide a fixating device having a first rotatable member in contact with an unfixated image borne on a recording medium, a second rotatable member forming a nip with said first rotatable member, a first heater for heating said first rotatable member, a second heater for heating said second rotatable member, and power supply controlling means for controlling the supply of electric power to said first heater and said second heater, said power supply controlling means being adapted to control the supply of electric power so that when the electric power supplied to said first heater is Wa and the electric power supplied to said second heater is Wb and the ratio when the recording medium is nipped between and conveyed by said first rotatable member and said second rotatable member is Dp=Wa/Wb and the ratio during standby is Ds=Wa/Wb, there may be established Dp>Ds.

Further objects of the present invention will become apparent from the following detailed description taken in conjunction with the accompanying drawings.

DESCRIPTION OF THE PREFERRED EMBODIMENTS

Some embodiments of the present invention will hereinafter be described with reference to the accompanying drawings.

[First Embodiment]

Figure 1:
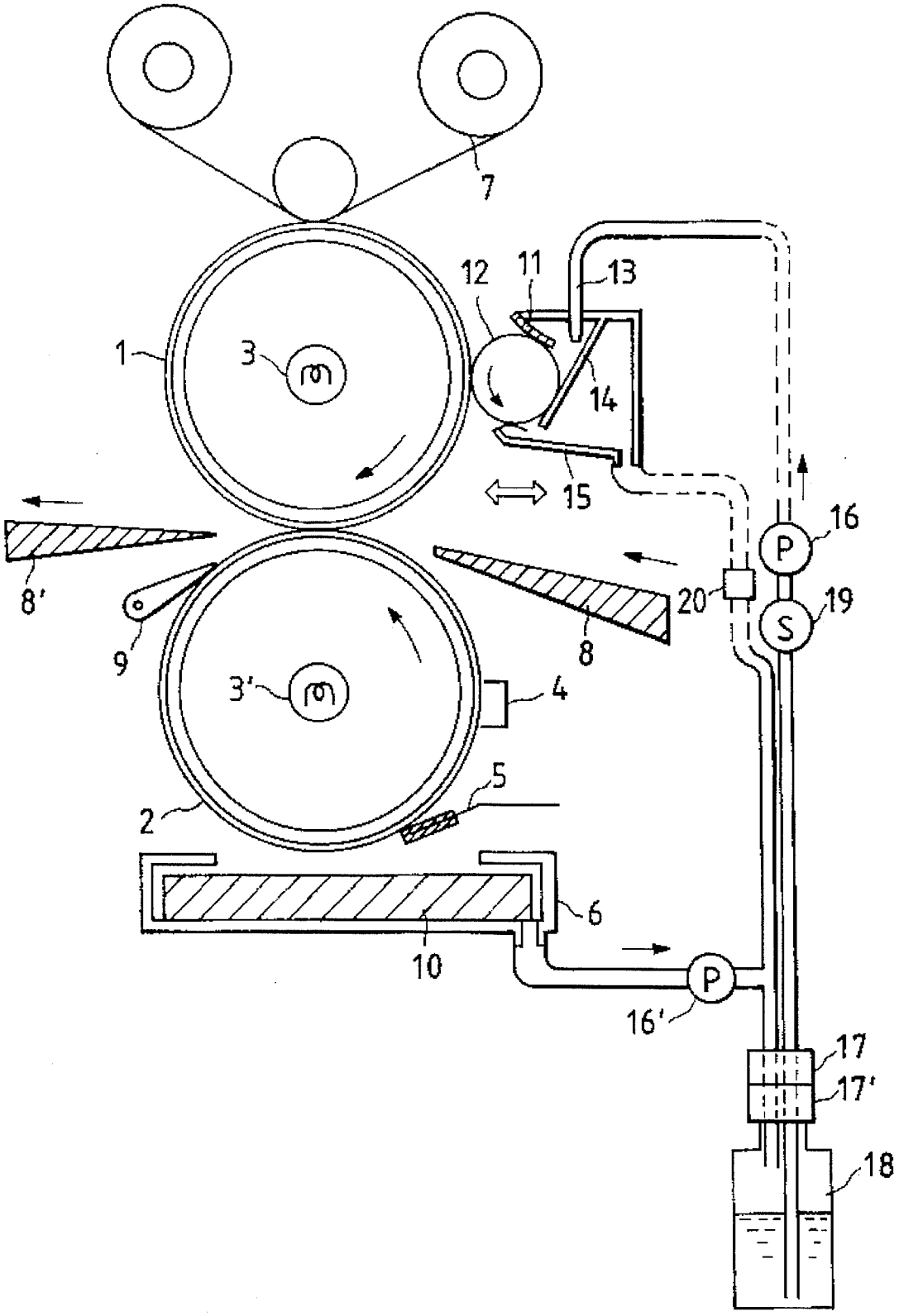
FIG. 1 is a vertical cross-sectional view of a fixating device according to a first embodiment of the present invention.

A first embodiment of the present invention will first be described with reference to FIGS. 1 and 2. In FIG. 1 which shows a fixating device, the reference numeral 1 designates a fixating roller (a first rotatable member), and a pressing roller 2 (a second rotatable member) is brought into pressure contact with the fixating roller 1 and follows the rotation of the fixating roller 1 while forming a nip portion between it and the fixating roller 1. The fixating roller 1 has an elastic layer on a hollow cylindrical mandrel made of aluminum, and a halogen heater 3 as a heat source is contained in the hollow space of the mandrel so that necessary heat for fixation may be supplied to the fixating roller 1. It is necessary that the elastic layer be provided to a thickness of several tens of μm or more to follow the thickness (several μm to several tens of μm) of multiplex toners of one to four colors of a color image. This is because if the elasticity of the elastic layer is small, there will be brought about a reduction in resolution by the crush of unfixated toners in the recesses of the toners. The material of this elastic layer may suitably be liquid silicone roller RTV of phenyl origin or dimethyl origin or rubber of LTV type because they have elasticity, and particularly RTV is suitable because its affinity with silicone oil is high and it permits oil to be readily applied thereto.

The pressing roller 2 also has an elastic layer on a hollow cylindrical mandrel made of aluminum, and a halogen heater 3' as a heat source is contained in the hollow space of the mandrel so as to heat the pressing roller 2. The elastic layer of this pressing roller 2 may be smaller in elasticity than that of the fixating roller 1 and therefore, its simplification is possible and a layer of HTV, fluorine rubber or the like may only be provided, and the surface thereof may be prevented from oil swelling by being coated with PFA or PTFE, and RTV may also be used.

A cleaning web 7 is disposed above the fixating roller 1 so as to frictionally slide on the surface of the fixating roller 1 after fixation and remove any offset toners. Also, an oil applying roller 12 having silicone rubber on its surface is disposed in contact with the surface of the fixating roller 1, and by this oil applying roller 12 being rotated in contact with the fixating roller, oil is applied to the surface of the fixating roller. The oil applying roller 12 is adapted to contact with the fixating roller to effect the application of the oil during fixation, and to be spaced apart from the fixating roller to prevent the dripping of the oil during non-fixation.

The oil is contained in an oil tank 18 having an aluminum pack in a rigid case and may be conveyed to an oil supply nozzle 13 by an oil pump 16 through joints 17, 17' and a tube of silicone resin or the like. Also, the oil conveyed from the oil supply nozzle 13 is retained by a minute amount on an oil reservoir plate 14 which is in close or very close contact with the oil applying roller 12, and the amount of oil is regulated by an oil applying blade 11 with the rotation of the oil applying roller 12 and a uniformly thin layer of oil is applied onto the oil applying roller 12.

Any excess oil which has not been applied at this time falls from the oil reservoir plate 14 and is collected from the bottom surface of an oil case 15 into the oil tank 18 through a check valve 20 and therefore, only a very small amount of oil is always present in the oil case 15. Therefore, the outward leakage of the oil will be almost prevented even if the inclination or fall of the unit itself happens during its separation from the main body. Of course, no leakage of the oil will happen for the inclination of the unit which may be caused by the movement of the main body when the unit is mounted on the main body.

A suitable amount of oil thus applied onto the fixating roller 1 by the oil applying roller 12 is absorbed or adheres to paper with the supply of the paper and goes out of the apparatus, while the oil applied to that portion of the fixating roller 1 which is not supplied with the paper or applied during the pre-rotation and post-rotation of the fixating roller adheres and shifts to the pressing roller 2 and is scraped off the pressing roller 2 with paper powder and toners by a cleaning blade 5, and falls into an oil pan 6 which is a waste oil collecting container disposed below the cleaning blade 5. In the oil pan 6, the oil which has fallen thereinto is quickly absorbed by an oil absorber 10 to thereby prevent the leakage of the oil during the inclination or fall of the unit.

This oil absorber 10 is formed of a fibrous material or a sponge material and performs also the function as a filter, and the oil filtrated by the oil absorber 10 is collected into the oil tank 18 by negative pressure being applied thereto by an oil pump 16' and is reused. It is because the oil has viscosity that negative pressure is applied, and by so constructing, it becomes possible to make the capacity of the oil pan 6 small and further, it is possible to save the oil.

The remaining amount of the oil thus circulatively utilized is detected by an oil remaining amount detecting sensor 19 and design is made such that the operator is pressed for interchanging the oil tank 18 when the remaining amount reaches a predetermined amount. The oil tank 18 is removably mountable by means of the joints 17, 17' formed of a combination of a rubber seal, a spring, etc., and during the mounting and dismounting thereof, oil seal is done by the joints 17, 17'. Also, the pumps 16 and 16' may preferably be electromagnetic pumps and may preferably adopt a type of controlling the amount of oil by a pulse signal. It is also inexpensive and good to use gear pumps. Further, the pumps each may preferably be provided with a check valve.

The oil supply portion comprised of the oil tank 18, joints 17, 17', oil pump 16, etc. as described above is a completely closed system and is free of the possibility of oil leakage and can therefore be provided on any of the apparatus body side and the fixating device side.

Further, as regards the quality of the oil, that which is now generally used is silicone oil, and the oil which is especially used is of dimethyl origin, and for example, KF-96 produced by Shinetsu Kagaku Co., Ltd. is well known. With regard to the viscosity of the oil, oil of viscosity of several tens of thousands of cs or less can be utilized, and oil of viscosity of several thousands of cs or less is preferable. Oil of viscosity of several tens of cs or less is high in volatility and is liable to stain charging wires in the apparatus and moreover is low in firing point and is problematic in terms of safety and thus, oil of viscosity of 100 cs or greater is preferable.

In the present embodiment as described above, paper (not shown) to which an unfixated toner image has been transferred is guided by a guide 8 and enters the nip portion from the right as viewed in FIG. 1, and is pressed and heated by the fixating roller 1 on which an oil layer has been formed as described above and the pressing roller 2, whereafter the paper is separated by a separating pawl 9 disposed so as to bear against the pressing roller 2, and is guided and discharged by a guide 8'.

Accordingly, to accomplish good fixation, it is necessary to keep the temperatures of the two rollers appropriate, and for the temperature control of the rollers in the present embodiment, a thermistor 4 which is temperature detecting means is disposed in contact with the pressing roller 2, and the surface temperature of the roller is detected by any variation in a resistance value resulting from the detected temperature, and the supply of electric power to the halogen heaters 3 and 3' is controlled by temperature (power supply) control means (not shown) such as a CPU so that the surface temperatures of the rollers may assume a predetermined value. However, when the two rollers are left stopped during standby, there is the possibility of a temperature difference being caused between the two rollers by the difference in the amount of heat escape, i.e., so-called heat leak, of the fixating roller 1 and of the pressing roller 2, and it is therefore necessary to effect appropriate temperature control.

So, in order to examine the relation between such temperature difference and temperature control, the following experiment was carried out. In the experiment, use was made of a fixating roller 1 having its surface layer formed of RTV or LTV silicone rubber and a pressing roller 2 having its surface layer formed of RTV, HTV or LTV silicone rubber or other fluorine rubber and coated with PFA or PTFE.

As the toner, use was made of sharp melt toner used in the color copying apparatus CLC-200 of Canon, Sales Co., Inc., the fixating temperature was 170° C. and the peripheral speed of the rollers was 100 mm/sec. The oil used was KF-96 (described above) of viscosity of 300 cs. The nip portion formed a pressed state over a width of the order of 5 to 6 mm, and the total amount of pressing was of the order of 40 kg.

Figure 2A:
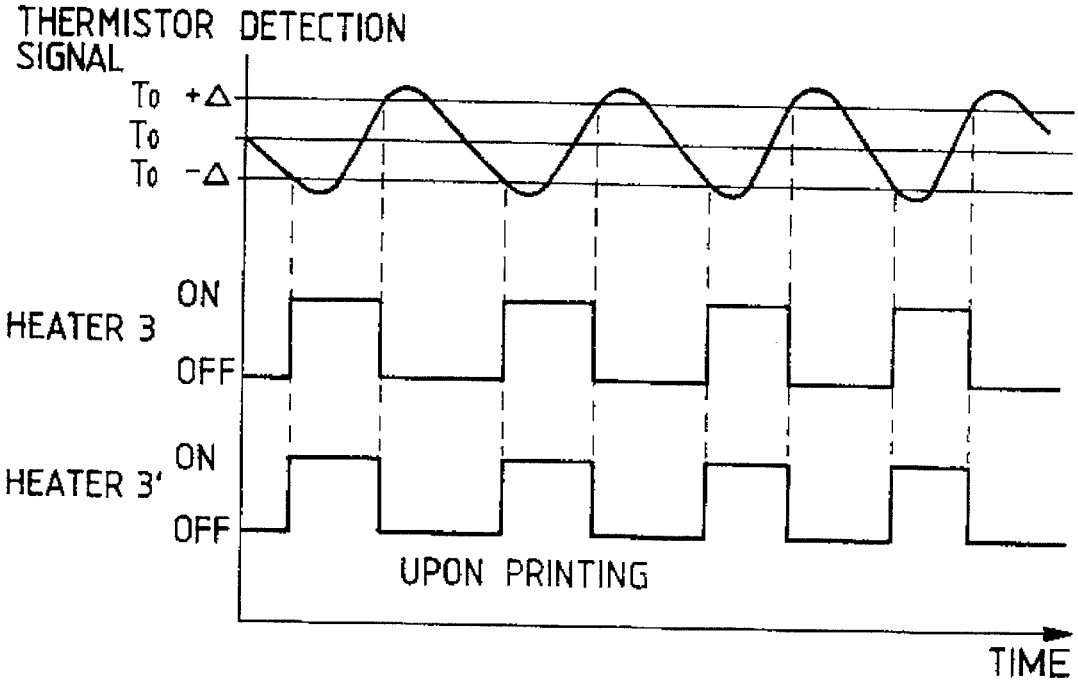
FIGS. 2A and 2B show examples of temperature control in the first embodiment of the present invention.
Figure 2B:
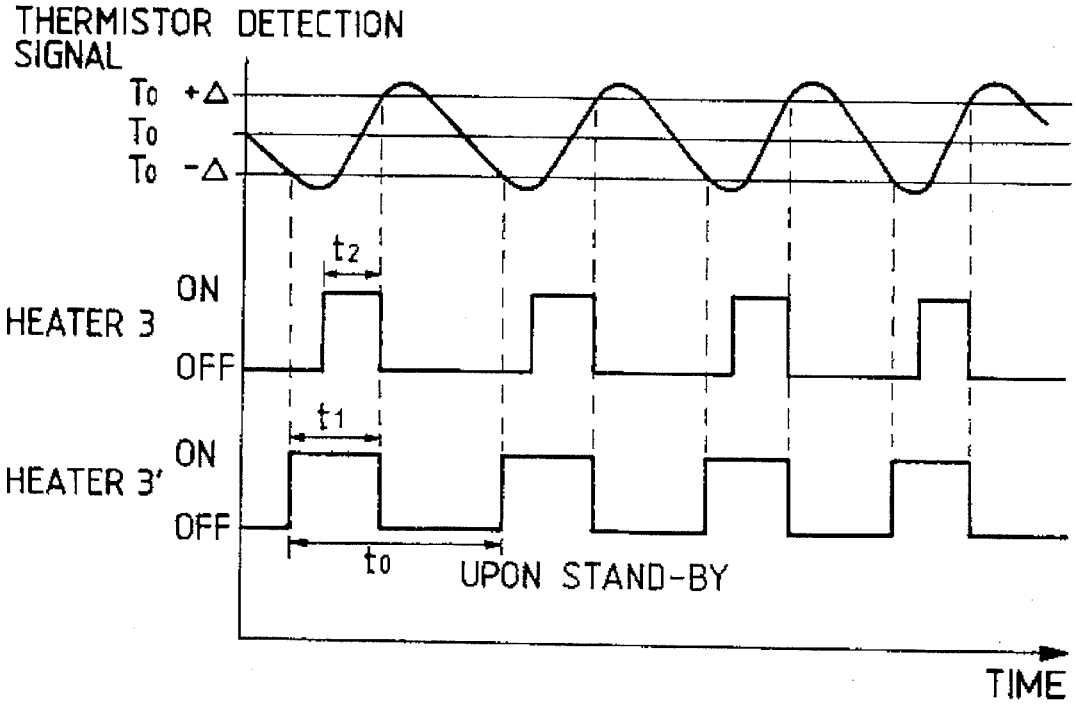

FIGS. 2A and 2B show an example of temperature control. This heater control was effected by a control system in which the heaters 3 and 3' were turned on and off at a time. In the experiment, in order to prevent any heater irregularity caused by noise, an insensitive zone width to a target set temperature $T_0$ was 0.7° C. and ON-OFF control based on the signal of the thermistor 4 was effected with a result that ripples could be formed substantially uniformly above and below the target set temperature $T_0$ (ripple width=1.4° C. to 30° C.).

During the continuous printing shown in FIG. 2A, $T_0$=170° C. was adopted and the ratio Dp between the turn-on times $t_p$ and $t_{p'}$ of the respective heaters 3 and 3' was $t_p/t_{p'}$=1/1, with a result the temperatures of the two rollers 1 and 2 could be within 170° C.±3° C. and stable temperature control was accomplished.

Next, during the standby shown in FIG. 2B, $T_0$= 160° C. was adopted and the ratio Ds between the turn-on times $t_2$ and $t_1$ of the respective heaters 3 and 3' was $t_2/t_1$=0.67/1, with a result that the temperatures of the two rollers 1 and 2 each were 160° C.±3° C. and no temperature difference was not caused even after the rollers were left stopped. Specifically, the turn-on period $t_0$=60 sec., the turn-on time $t_2$ of the heater 3 was $t_2$=10 sec. and the turn-on time $t_1$ of the heater 3' was $t_1$=15 sec.

Incidentally, when as during the printing, the turn-on times of the heaters were 1/1 during the standby, the temperatures of the fixating roller 1 and pressing roller 2 became 176° C. and 160° C., respectively, in 20 minutes after the rollers were left stopped, and thus a great temperature difference appeared. If there is such a temperature difference during the standby, the difference in the deterioration of rubber by temperature will appear in the form of the difference between the service lives of the two rollers and therefore, the times for the interchange of the two rollers will become discrete from each other, and this is disadvantageous for maintenance. Also, when the two rollers are to be interchanged as a fixating unit, the interchange will be done in a state in which one of the rollers still have a service life, and this is uneconomical.

Accordingly, the control system as described above in which the turn-on time of the heater 3 in the fixating roller 1 is made shorter than the turn-on time of the heater 3' in the pressing roller 2 is preferable. As a result of the experiment, it has been found that it is also possible to shift the turn-on times of the two heaters 3 and 3' by a method of shortening the ON time by an amount multiplied by a certain coefficient, such as determining the ON time $\tau_2$ of one heater (in the present embodiment, the heater 3 in the fixating roller 1) relative to the ON time $\tau_1$ of the other heater on that side on which temperature detection is effected by the thermistor 4 (in the present embodiment, the heater 3' in the pressing roller 2). As $\tau_2=\alpha\tau_1$ ($\alpha$ being a constant and being 0.7 in the present embodiment). Also, when $\alpha\cong1$, it has also been possible to effect substantially equal control by a method of making the ON time shorter, like $\tau_2=\tau_1-A$ (A being a constant). It is better to finely control these coefficients and constant values by environmental conditions such as humidity and room temperature and the lapse of time after the closing of a power source switch. In the experiment, as the values for making the temperatures of the upper and lower rollers coincident with each other when the various conditions have been changed, $\alpha$ cold assume a range of 2 to 0.4 and A could assume a range of 3.4 sec. to 4.4 sec. The fluctuation of the turn-on period itself has been little and has been stable at the order of 60 sec. to 64 sec. It has been found that besides the above-described method of delaying the ON timing of the heater 3 in the fixating roller 1 as shown in FIGS. 2A and 2B, a method of delaying the OFF timing of the heater 3' in the pressing roller 2 or a control system comprising a combination thereof is also possible.

What become references when this control is effected are the reference turn-on period $t_0$ by thermistor detection and the ON time $t_1$ of the heater in the roller on the thermistor detection side. For example, $t_1$ may be measured by an amount corresponding to one period and $t_2$ in the next period may be determined, or in order to reduce the fluctuation of temperature control, the total value or average value of the times corresponding to a plurality of periods may be used to determine the next period $t_2$. Of course, an average value $t_2$ including the individual difference irregularity between apparatuses may be supposed in advance and a delay time $\Delta t=t_1-t_2$ may be set. Further, as a system for controlling both of the ON times $t_1$ and $t_2$ of the two heaters, $t_1$ and $t_0$ may be measured before one or more periods and $t_1$ and $t_2$ in the next period may be determined.

In the method of shortening the ON time of the heater 3 in the fixating roller 1, the period and ripple have very little difference from those when $\alpha=1$ and there is the advantage that stability is high. Also, in the method of extending the ON time of the heater 3' in the pressing roller 2, there is the advantage that although the ripple becomes somewhat great, control is difficult to diffuse and is simple. As regards warn-up, in the experiment, the heat capacities of the two rollers were set so that for the full turn-on (100%) of the two heaters, the rising times of the two rollers might coincide with each other.

The average electric power in each mode state of the fixating device according to the present embodiment is shown in the table below. In the table, the average electric powers in the two heaters are represented by Wa and Wb.

TABLE 1

| | warm-up (1/1) | standby (0.7/1) | print (1/1) |
|---|---|---|---|
| heater 3 (Wa) | 340 W (100%) | 60 W (18%) | 210 W (62%) |
| heater 3' (Wb) | 340 W (100%) | 85 W (25%) | 210 W (62%) |

The parentheses after each state show the turn-on percentages of the two heaters and just coincide with the average electric power percentage (Wa/Wb) of the two heaters. The parentheses after the electric power represent the average electric power to 100% during the full turn-on of each heater. In the foregoing description, the two heaters are of the same output, but of course, the two heaters may differ in output from each other, and control can be effected so that the average electric power ratio Ds of the two heaters during standby may be smaller than the average electric power ratio Dp'/Dp during warm-up or printing (when a recording medium is nipped between and conveyed by the pair of rollers). In the description hitherto, ON-OFF control has been used and therefore, the average electric power ratio of the two heaters has been controlled by the turn-on times of the two heaters, but it is apparent that in the other ordinary control, such as duty control, wave number control, PWM control or phase control, only the average electric power ratio of the two heaters can be taken into account.

During standby (the electric power ratio Ds=0.7/1 of the two heaters), the heat leak made up for to keep the fixating roller 1 warm is 60 W and the heat leak of the pressing roller 2 is 85 W, and this indicates that the heat leak of the fixating roller 1 is smaller by 15 W (about 30%) than the heat leak of the pressing roller 2. At this time, the temperatures of the two rollers coincide with each other at 160° C.

[Second Embodiment]

A second embodiment of the present invention will now be described with reference to FIGS. 3 to 5. In this embodiment, portions common to those in the first embodiment are given the same reference characters and need not be described.

Figure 3:
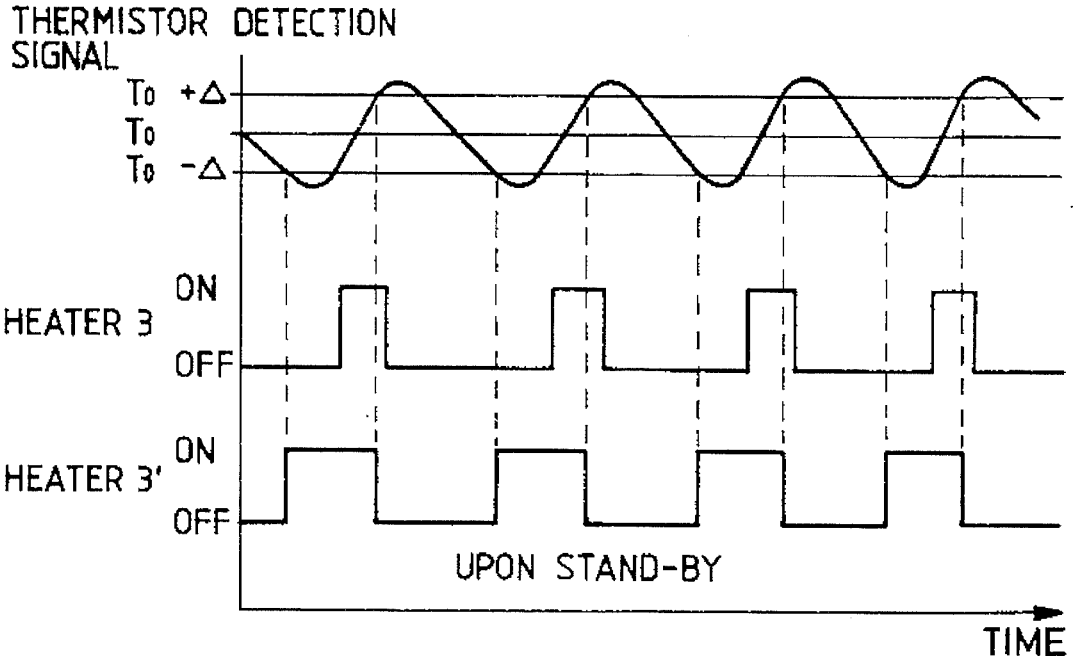
FIG. 3 shows an example of temperature control in a second embodiment of the present invention.
Figure 4:
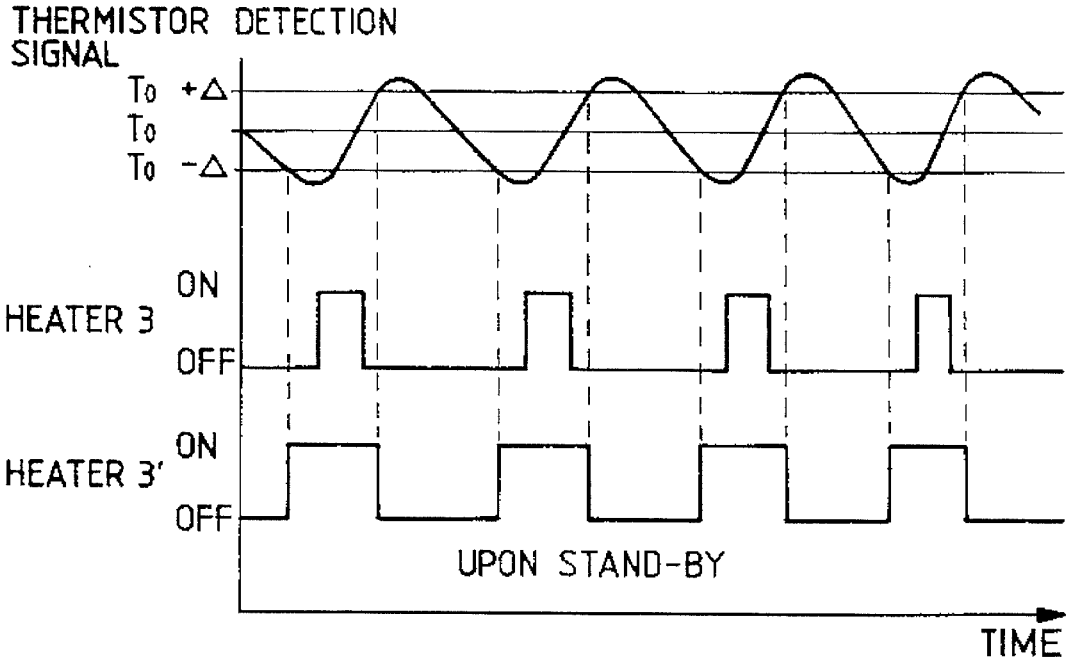
FIG. 4 shows another example of temperature control in the second embodiment of the present invention.
Figure 5:
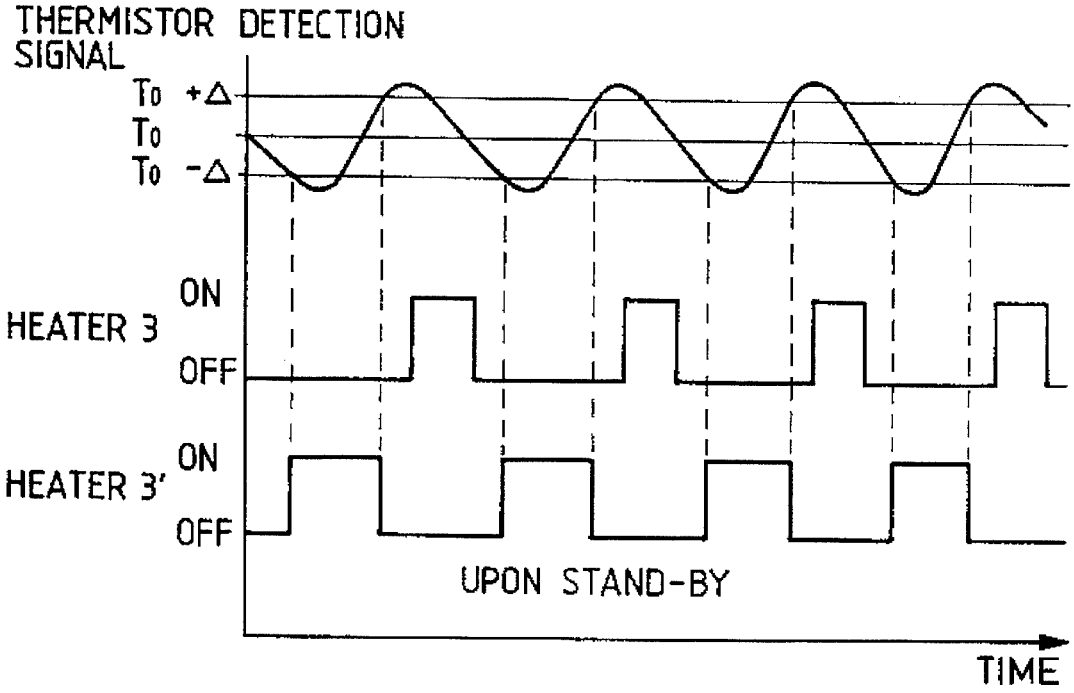
FIG. 5 shows still another example of temperature control in the second embodiment of the present invention.

If the turn-on and off of the two heaters are effected at a time, the fluctuation of the rush current will be great and this will sometimes pose a problem to the noise standard and therefore, as shown in FIG. 3 or 4, control in which the OFF time is deviated may be adopted, or as shown in FIG. 5, control in which the two heaters are alternately turned on may be effected.

[Third Embodiment]

A third embodiment of the present invention will now be described with reference to FIGS. 6 to 9. In this embodiment, portions common to those in the first embodiment are given the same reference characters and need not be described.

Figure 6:
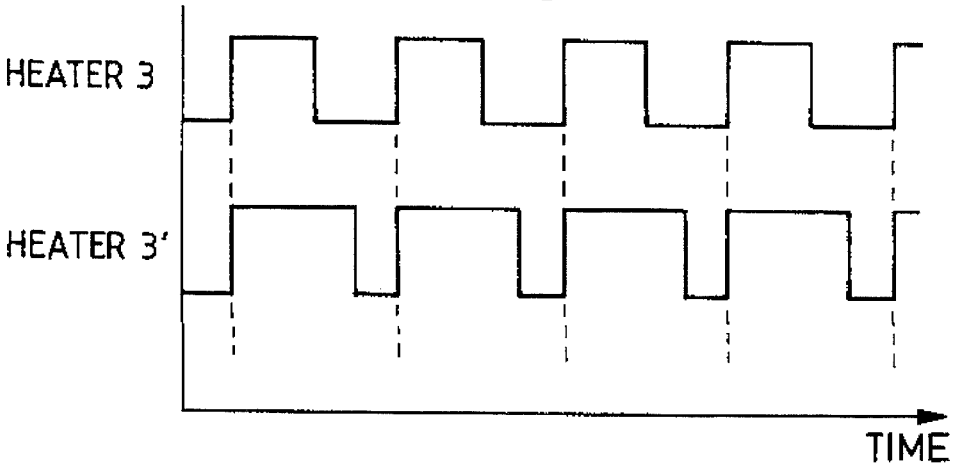
FIG. 6 shows an example of temperature control in a third embodiment of the present invention.

Besides the ON-OFF control as described above, it is possible to adopt a system which uses duty control as shown in FIG. 6 wherein during ON, the heaters are not fully turned on but are intermittently turned on at a certain duty ratio, thereby change the duty ratio of the turn-on of the two heaters during standby and during printing.

Figure 7:
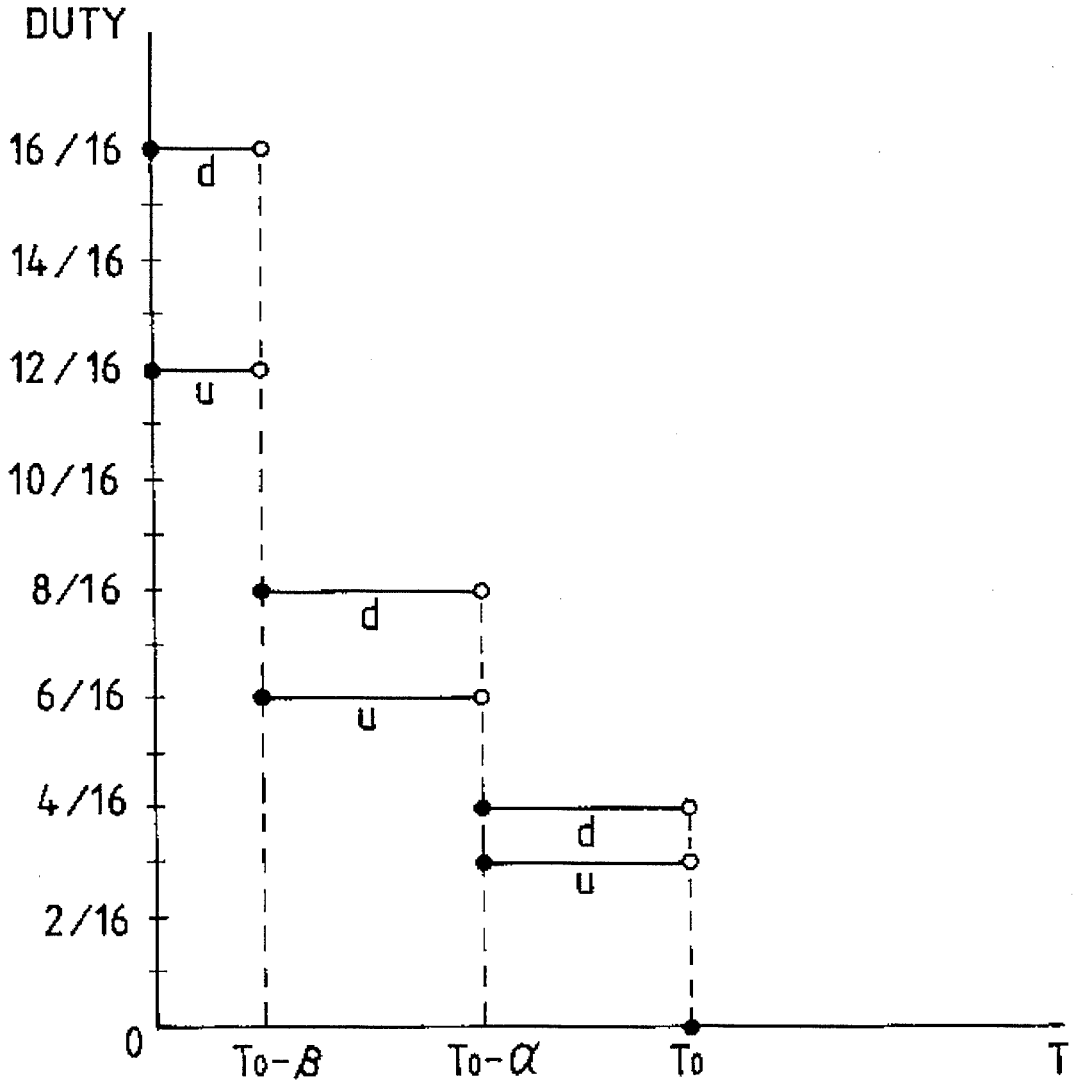
FIG. 7 shows an example of the duty of the heat sources of two rollers in the third embodiment of the present invention.

Again in this case, it is possible to change the duty of only the heater 3 in the fixating roller 1, or to change the duty of only the heater 3' in the pressing roller 2, or to change the duties of both of the two heaters. For example, as shown in FIG. 7, the output level, i.e., the duty, is made to correspond to the target temperature $T_0$ in conformity with the difference $\Delta T$ thereof from the thermistor-detected temperature T. Of course, besides this, various forms of correspondence are possible. For simplicity, here is shown the manner in which three kinds of output levels are set for temperatures below $T_0$. The duty has been provided at 16 levels by dividing the reference period into 16. In FIG. 7, the output level of the heater 3 in the fixating roller 1 is represented by u, and the output level of the heater 3' in the pressing roller 2 is represented by d ($\alpha$, $\beta>0$, $\alpha<\beta$).

Here, by the duty ratio of the two heaters, the average electric power ratio of the two heaters is 1/1 during printing and during warm-up, and during standby, (the duty of the heater 3 in the fixating roller 1)/(the duty of the heater 3' in the pressing roller 2)=0.75/1.

Figure 8:
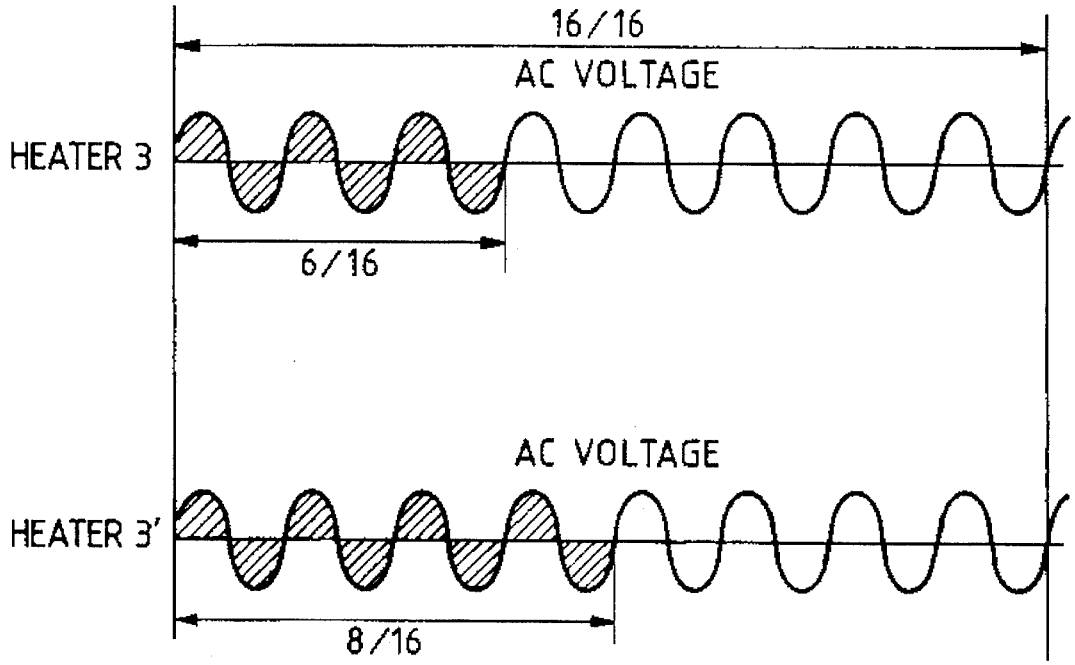
FIG. 8 shows another example of temperature control in the third embodiment of the present invention.

Regarding the actual outputs, as shown in FIG. 8, it is also possible to take the duty period by 8 waves relative to, for example, the period (1/50 sec., 1/60 sec.) of an AC power source, and take the duty ratio with a half wave as a unit.

Figure 9:
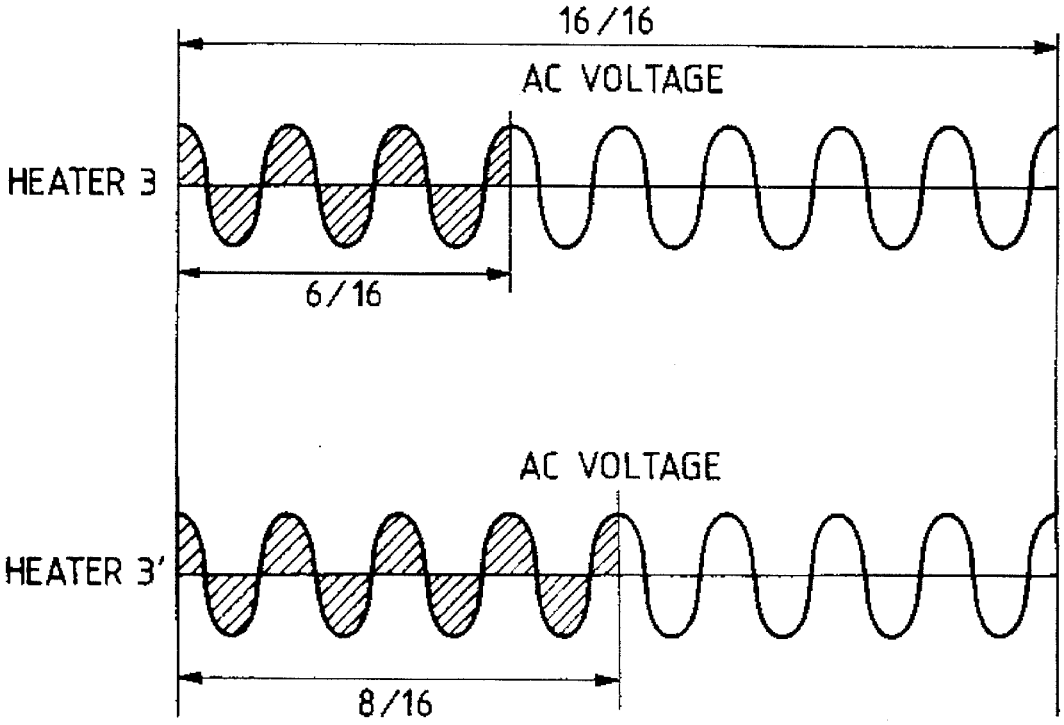
FIG. 9 shows still another example of temperature control in the third embodiment of the present invention.

Further, it will be better to shift the output by ¼ wave as a countermeasure for noise to make a zero cross, as shown in FIG. 9.

[Fourth Embodiment]

A fourth embodiment of the present invention will now be described with reference to FIGS. 10 and 11. In this embodiment, portions common to those in the first embodiment are given the same reference characters and need not be described.

Figure 10:
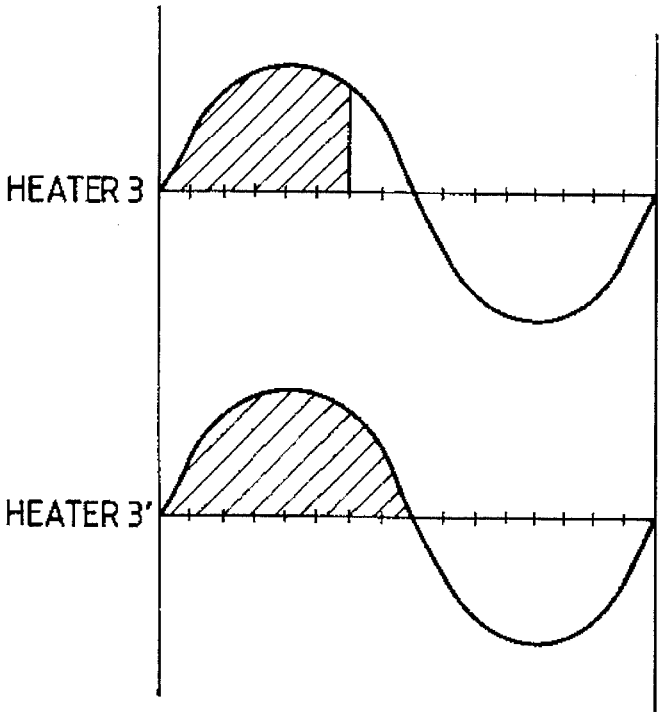
FIG. 10 shows an example of temperature control in a fourth embodiment of the present invention.
Figure 11:
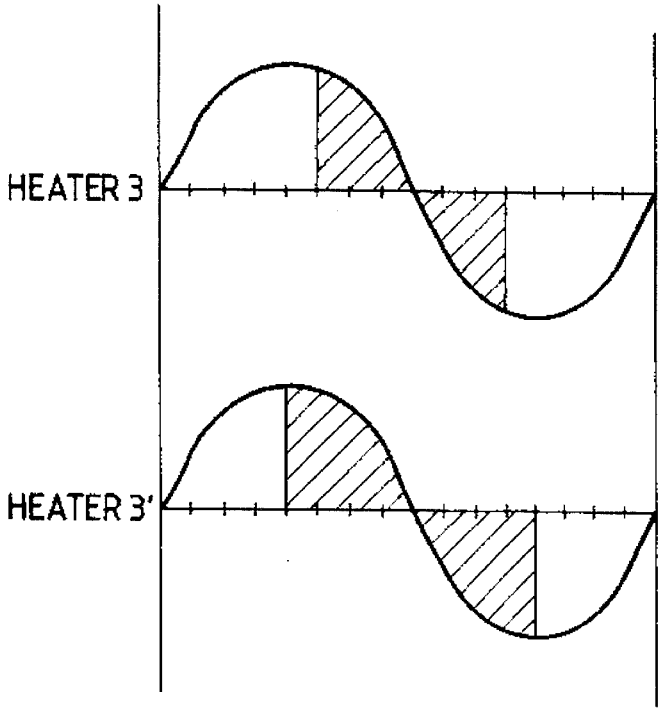
FIG. 11 shows another example of temperature control in the fourth embodiment of the present invention.
Figure 12:
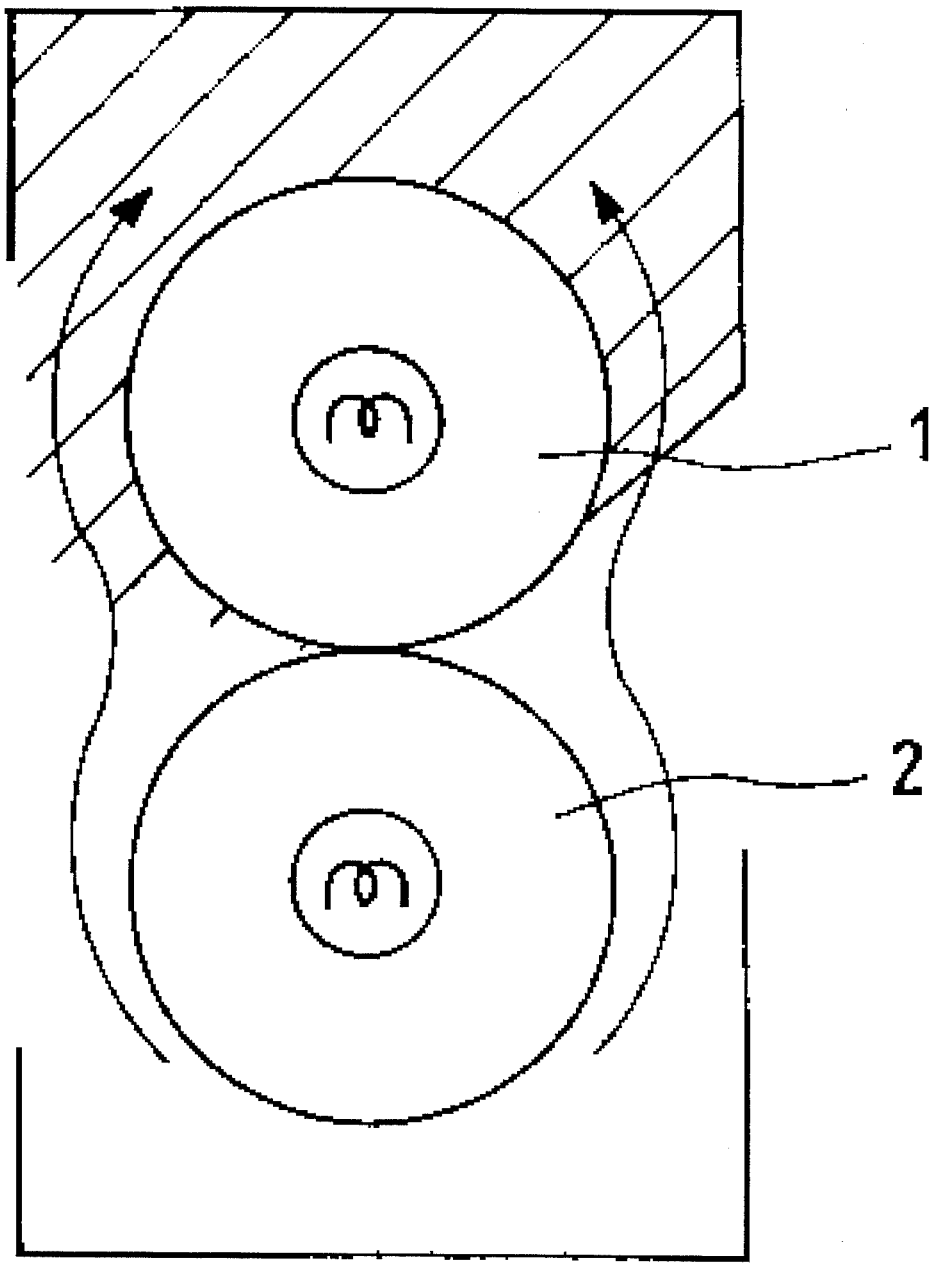
FIG. 12 is a view for illustrating the movement of heat during standby in a fixating device according to the prior art.

Instead of the duty control method in the third embodiment, as shown in FIG. 10, the amount of phase integration per AC wave may be changed by a phase control method and be outputted. Again in this method, it is possible to make a zero cross as shown in FIG. 11. Again here, it is possible to make the average electric power ratio of the two heaters greater during printing or warm-up than during standby to thereby prevent the occurrence of a temperature difference between the two rollers during standby.

As described above, even in a fixating device wherein both of rollers disposed above and below are provided with heat sources and one of the rollers is provided with temperature detecting means, the ratio of the average electric power of the heat source of the upper roller to the average electric power of the heat source of the lower roller is made smaller during standby than during printing and therefore, it is possible to eliminate the temperature difference between the upper and lower rollers without any increase in cost. Accordingly, the upper and lower rollers become equal in service life to each other and are suitable for unit interchange. Also, the temperature irregularity between the upper and lower rollers becomes null from standby till printing, whereby image qualities such as fixative property and luster become stable. Also, the danger of the temperature rise of the rollers is null and safety heightens.

Also, if the intermittent power supply period of one of the heat sources is measured and the average electric power ratio of the two heat sources is changed on the basis of said period, appropriate temperature control could be accomplished even when the rise rate or the fall rate of temperature is varied by changes in the environment.

Further, if the power supply start timing for at least the heat source in the upper roller is delayed during standby relative to during printing to thereby change the average electric power ratio, it will be possible to suppress the temperature rise of the upper roller, make the temperature ripple small and eliminate the temperature difference between the two rollers.

Also, if the power supply start timing for at least the heat source in the lower roller is delayed during standby relative to during printing to thereby change the average electric power ratio, it will be possible to suppress the temperature fall of the lower roller and eliminate the temperature difference between the two rollers by simple control.

Furthermore, if the supply of electric power to the heat sources of the two rollers is effected at a predetermined duty ratio within the power supply period and the ratio of the duty of the heat source in the upper roller to the duty of the heat source in the lower roller is made smaller during standby than during printing, it will be possible to reduce consumed electric power and yet eliminate the temperature difference between the two rollers.

The present invention is not restricted to the above-described embodiments, but covers all modifications within the technical idea thereof.

What is claimed is:

1. A fixating device, comprising:

a first rotatable member in contact with an unfixated image borne on a recording medium;

a second rotatable member forming a nip together with said first rotatable member;

a first heater for heating said first rotatable member;

a second heater for heating said second rotatable member; and power supply controlling means for controlling supply of electric power to said first heater and said second heater, said power supply controlling means being adapted to control the supply of electric power so that when the electric power supplied to said first heater is Wa and the electric power supplied to said second heater is Wb and the ratio when the recording medium is nipped between and conveyed by said first rotatable member and said second rotatable member is Dp=Wa/Wb and the ratio during standby is Ds=Wa/Wb, there may be established Dp>Ds.

2. A fixating device according to claim 1, wherein said power supply controlling means controls the supply of electric power so that the ratio Ds may be Ds<1.

3. A fixating device according to claim 1, further having temperature detecting means for detecting the temperature of at least one of said first rotatable member and said second rotatable member, and wherein said power supply controlling means controls the supply of electric power on the basis of the temperature detected by said temperature detecting means.

4. A fixating device, comprising:

a first rotatable member in contact with an unfixated image borne on a recording medium;

a second rotatable member forming a nip together with said first rotatable member;

a first heater for heating said first rotatable member;

a second heater for heating said second rotatable member; and power supply controlling means for controlling supply of electric power to said first heater and said second heater, said power supply controlling means being adapted to control the supply of electric power so that when the electric power supplied to said first heater is Wa and the electric power supplied to said second heater is Wb and the ratio during warm-up is D'p=Wa/Wb and the ratio during standby is Ds=Wa/Wb, there may be established D'p>Ds.

5. A fixating device according to claim 4, wherein said power supply controlling means controls the supply of electric power so that the ratio Ds may be Ds<1.

6. A fixating device according to claim 4, further comprising temperature detecting means for detecting the temperature of at least one of said first rotatable member and said second rotatable member, wherein said power supply controlling means controls the supply of electric power on the basis of the temperature detected by said temperature detecting means.

* * * * *